US007190316B2

(12) United States Patent
Yegin et al.

(10) Patent No.: US 7,190,316 B2
(45) Date of Patent: Mar. 13, 2007

(54) VEHICULAR GLASS-MOUNT ANTENNA AND SYSTEM

(75) Inventors: Korkut Yegin, Grand Blanc, MI (US); Nazar F. Bally, Sterling Heights, MI (US); Randall J. Snoeyink, Clarkson, MI (US); William R. Livengood, Grand Blanc, MI (US)

(73) Assignee: Delphi Techologies, Inc., Troy, MI (US)

( * ) Notice: Subject to any disclaimer, the term of this patent is extended or adjusted under 35 U.S.C. 154(b) by 53 days.

(21) Appl. No.: 10/985,551

(22) Filed: Nov. 10, 2004

(65) Prior Publication Data

US 2005/0195114 A1 Sep. 8, 2005

Related U.S. Application Data

(60) Provisional application No. 60/550,280, filed on Mar. 5, 2004.

(51) Int. Cl.
*H01Q 1/32* (2006.01)

(52) U.S. Cl. ..... 343/713; 343/700 MS

(58) Field of Classification Search ..... 343/713, 343/711, 712, 704, 700 MS, 714, 717, 846
See application file for complete search history.

(56) References Cited

U.S. PATENT DOCUMENTS

| | | | | |
|---|---|---|---|---|
| 5,043,738 | A * | 8/1991 | Shapiro et al. | 343/700 MS |
| 5,448,250 | A * | 9/1995 | Day | 343/700 MS |
| 5,453,751 | A * | 9/1995 | Tsukamoto et al. | 343/700 MS |
| 5,633,645 | A * | 5/1997 | Day | 343/700 MS |
| 5,712,645 | A | 1/1998 | Jellum et al. | |
| 5,742,255 | A | 4/1998 | Afendras | |
| 6,900,766 | B2 * | 5/2005 | Komatsu et al. | 343/700 MS |
| 2003/0137464 | A1 * | 7/2003 | Foti et al. | 343/770 |
| 2004/0119642 | A1 | 6/2004 | Truthan | |
| 2004/0135731 | A1 * | 7/2004 | Komatsu et al. | 343/713 |

FOREIGN PATENT DOCUMENTS

EP 0 590 928 4/1994

OTHER PUBLICATIONS

European Search Report dated Jan. 24, 2006.

* cited by examiner

*Primary Examiner*—Hoanganh Le
(74) *Attorney, Agent, or Firm*—Jimmy L. Funke

(57) ABSTRACT

An antenna system for a vehicle including a rear windshield is disclosed. The antenna system comprises a global positioning system (GPS) antenna unit including a radiating element electromagnetically coupled to an excitation element about the rear windshield glass.

5 Claims, 7 Drawing Sheets

VEHICULAR GLASS-MOUNT ANTENNA AND SYSTEM

RELATED APPLICATIONS

The present application claims priority to U.S. provisional application Ser. No. 60/550,280 filed on Mar. 5, 2004.

TECHNICAL FIELD

The present invention generally relates to vehicular glass-mount antennas having improved radiation characteristics.

BACKGROUND OF THE INVENTION

It is known in the art that automotive vehicles are commonly equipped with audio radios that receive and process signals relating to amplitude modulation/frequency modulation (AM/FM) antennas, satellite digital audio radio systems (SDARS) antennas, global positioning system (GPS) antennas, digital audio broadcast (DAB) antennas, dual-band personal communication systems digital/analog mobile phone service (PCS/AMPS) antennas, Remote Keyless Entry (RKE) antennas, Tire Pressure Monitoring System antennas, and other wireless systems.

Currently, patch antennas are employed for reception and transmission of GPS [i.e. right-hand-circular-polarization (RHCP) waves] and SDARS [i.e. left-hand-circular-polarization (LHCP) waves]. Patch antennas may be considered to be a 'single element' antenna that incorporates performance characteristics of 'dual element' antennas that essentially receives terrestrial and satellite signals. SDARS, for example, offer digital radio service covering a large geographic area, such as North America. Satellite-based digital audio radio services generally employ either geo-stationary orbit satellites or highly elliptical orbit satellites that receive uplinked programming, which, in turn, is re-broadcasted directly to digital radios in vehicles on the ground that subscribe to the service. SDARS also use terrestrial repeater networks via ground-based towers using different modulation and transmission techniques in urban areas to supplement the availability of satellite broadcasting service by terrestrially broadcasting the same information. The reception of signals from ground-based broadcast stations is termed as terrestrial coverage. Hence, an SDARS antenna is required to have satellite and terrestrial coverage with reception quality determined by the service providers, and each vehicle subscribing to the digital service generally includes a digital radio having a receiver and one or more antennas for receiving the digital broadcast. GPS antennas, on the other hand, have a broad hemispherical coverage with a maximum antenna gain at the zenith (i.e. hemispherical coverage includes signals from 0° elevation at the earth's surface to signals from 90° elevation up at the sky). Emergency systems that utilize GPS, such as OnStar™, tend to have more stringent antenna specifications.

Unlike GPS antennas which track multiple satellites at a given time, SDARS patch antennas are operated at higher frequency bands and presently track only two satellites at a time. Thus, the mounting location for SDARS patch antennas makes antenna reception a sensitive issue with respect to the position of the antenna on a vehicle. As a result, SDARS patch antennas are typically mounted exterior to the vehicle, usually on the roof, or alternatively, inside the vehicle in a hidden location, for example, within an instrument panel. In some instances, such as cellular telephone mast antennas, have been located on the exterior surface of automotive glass and the received signals are electromagnetically coupled through the glass to the vehicle's receiver. Electromagnetically coupling such antennas in an SDARS application, without an external amplifier, is very difficult due to inherent loss and distorted radiation patterns associated with front windshield glass composition, which includes an intermediate plastic layer sandwiched between inner and outer glass layers. Additionally, external antennas are highly visible, prone to being damaged, and not aesthetically pleasing.

With respect to GPS antenna performance, GPS antennas mounted on a location other than the roof of the vehicle suffer degradation at lower elevation angles and rely on peak antenna gain to capture signals from multiple-tracked satellites. This feature of the antenna performance can be exploited to place the antenna at any desirable location inside the vehicle, such as on the rear-windshield glass. Although GPS antennas may be located on the front windshield glass as well, the front glass may introduce losses in addition to losses associated with the intermediate plastic layer of the front windshield glass. For example, the front windshield glass may include a high degree of curvature that causes the front glass to act as a lens that distorts the received radiation pattern by focusing waves at different locations other than the antenna.

SUMMARY OF THE INVENTION

The inventors of the present invention have recognized these and other problems associated with glass-mount antennas. To this end, the inventors have developed an antenna system associated with rear windshield. The antenna system comprises an global positioning system (GPS) antenna unit including a radiating element electromagnetically coupled to an excitation element. According to one embodiment of the invention, the radiating element may be coupled to the front windshield glass, and the excitation element may be positioned on a passenger compartment interior surface of the front windshield glass. The radiating element and/or the excitation element may also be located within the rear windshield glass. The antenna system also comprises a high-gain dual element antenna unit including a first radiating element, a second radiating element, a 90-degree phase shift circuit, and a low noise amplifier that is directly pin-feed coupled to the phase shift circuit. The radiating elements receive signals through the rear windshield glass. The antenna unit and the high-gain duel element antenna unit may function in a diversity antenna configuration.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
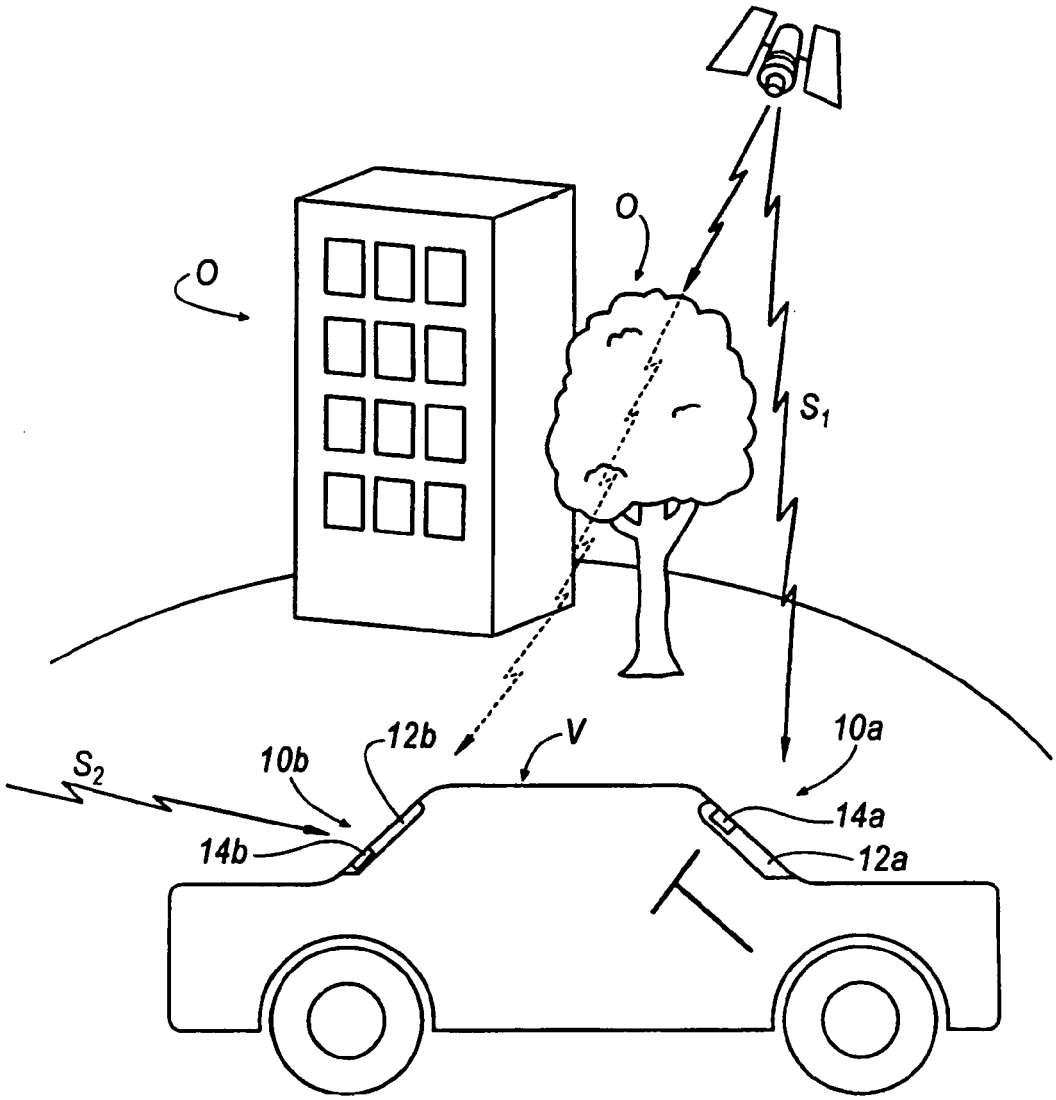
FIG. 1 illustrates a general side view of the vehicle glass mount antenna system.
Figure 2:
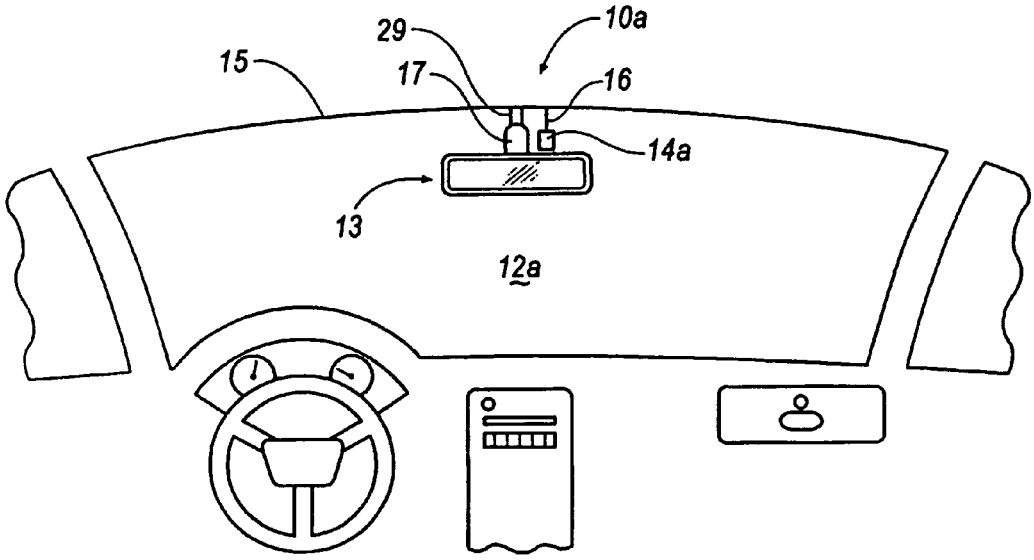
FIG. 2 illustrates a passenger compartment view of a front windshield glass mount antenna according to one embodiment of the invention.
Figure 3:
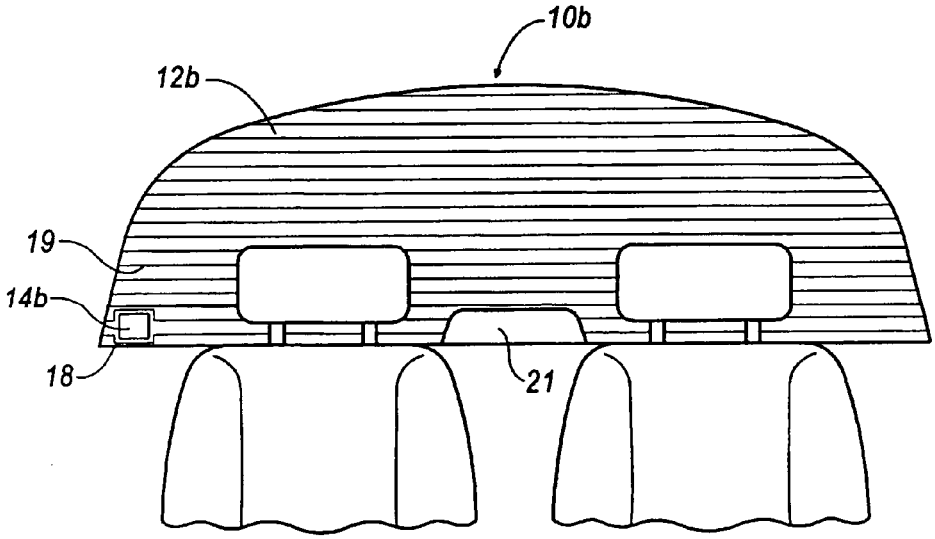
FIG. 3 illustrates a passenger compartment view of a rear glass mount antenna according to one embodiment of the invention.

The above described disadvantages are overcome and a number of advantages are realized by inventive antenna systems, which are generally illustrated at 10*a*, 10*b* in FIGS. 1–3. As illustrated in FIG. 1, a vehicle, V, includes a front windshield glass 12*a* and rear windshield glass 12*b* each including antenna units 14*a*, 14*b*, respectively. Referring to FIG. 2, the antenna unit 14*a* is shown proximate a rear-view mirror assembly 13 mounted via an adjacent arm 17 at a top portion 15 of the front windshield glass 12*a* that meets a headliner (not shown). The location of headliner provides the shortest path to route and hide wires 16 extending from the antenna unit 14*a* and rear-view mirror assembly 13. When implemented near the top portion 15, the antenna unit 14*a* should not come into direct contact with the vehicle body so as to ensure that the antenna unit 14*a* is not shorted out. As seen in FIG. 3, the antenna unit 14*b* is located near a corner 18 of the rear windshield glass 12*b* such that defroster wires 19 are routed about the mounting location of the antenna unit 14*b*. Although the antenna unit 14*b* is shown near the corner 18, the antenna unit 14*b* can be located at any desirable location on the rear windshield glass 12*b*, but more preferably, in a location that is less visible to the vehicle passengers and driver. For example, in an alternative embodiment, the antenna unit 14*b* may be located between the rear windshield glass 12*b* and a rear brake light housing 21 so as to completely hide the antenna unit 14*b* from the passengers and driver.

Figure 4A:
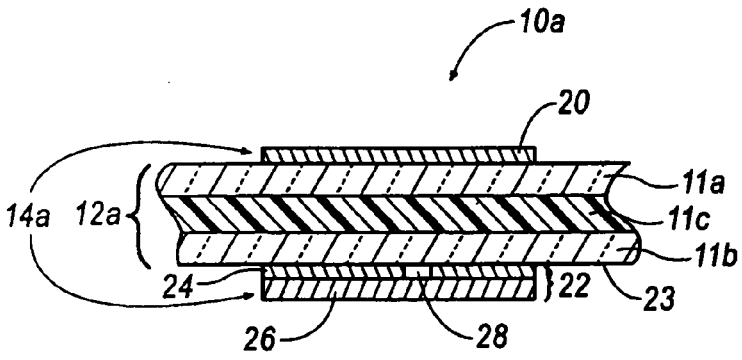
FIG. 4A illustrates a cross-sectional view of the front windshield glass mount antenna according to one embodiment of the invention.
Figure 5A:
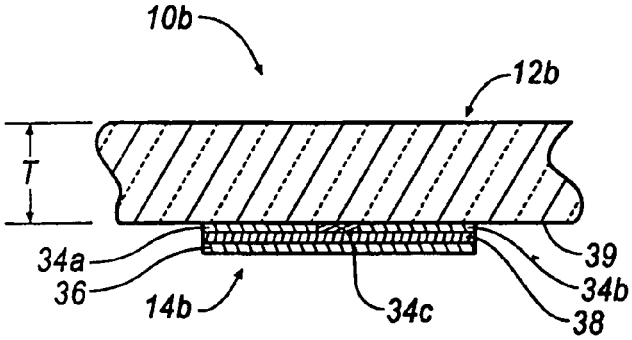
FIG. 5A illustrates a cross-sectional view of the rear windshield glass mount antenna according to one embodiment of the invention.

Referring now to FIGS. 4A and 5A, it is illustrated that the front windshield glass 12*a* (FIG. 4A) includes a layer of plastic film 11*c* that is sandwiched between an outer glass layer 11*a* and an inner glass layer 11*b*, whereas, conversely, the rear windshield glass 12*b* (FIG. 5A) does not comprise an intermediate plastic film layer 11*c* (FIG. 4A), but rather a unit of glass defined by a thickness, T. Because the outer layer of glass 11*a* is exposed to the elements, which may undesirably result in failure and cracking, the inner layer of glass 11*b* is separated and shielded from the outer glass 11*a* by the intermediate plastic film layer 11*c*. Although sufficient in preventing complete physical failure of the front windshield glass 12*a* as described above, the plastic film layer 11*c* introduces losses and distorted radiation patterns related to antenna performance, which may significantly degrade the electromagnetic coupling characteristics of conventional on-glass antennas related to GPS applications.

Figure 4B:
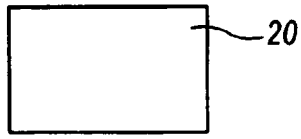
FIG. 4B illustrates a top view of a first element of the front windshield glass mount antenna according to FIG. 4A.
Figure 4C:
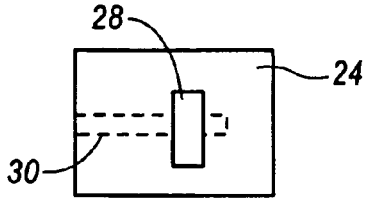
FIG. 4C illustrates a top view of a second element of the front windshield glass mount antenna according to FIG. 4A.

As seen in FIGS. 4A–4C, the antenna unit 14*a*, which is hereinafter referred to as an aperture coupled, slot-wave antenna 14*a*, provides a vehicular glass mount patch antenna while also improving electromagnetic coupling performance over conventional front windshield-mount antennas. The aperture coupled, slot-wave antenna 14*a* is essentially a two-element antenna system such that the radiation element is electromagnetically coupled through the front windshield glass 12*a* to an excitation part located on the interior surface of the front windshield glass 12*a*.

As illustrated, the first element of the aperture coupled, slot-wave antenna 14*a* includes a substantially rectangular top metallization 20 (i.e. the radiation element). The substantially rectangular top metallization 20 is linearly polarized (i.e. to receive terrestrial signals) and may include any desirable conducting material, such as, for example, a silver conducting film. In an alternative embodiment, the top metallization 20 may include an optically transparent conducting film comprising, for example, indium peroxide, to reduce the appearance of the aperture-couple slot-wave antenna 14*a* located about the front windshield glass 12*a*. The second element of the aperture coupled, slot-wave antenna 14*a* includes a bottom portion 22 (i.e. the excitation element) that is electromagnetically coupled through at least one layer 11*a*–11*c* of the three-layered windshield glass 12*a*.

The bottom portion 22 includes a substantially rectangular metal layer 24 and low noise amplifier (LNA) circuit 26. As illustrated, the metal layer 24 is further defined to include an absence of material in the form of a substantially off-centered rectangular slot 28. Additionally, the metal layer 24 is excited by a microstrip line 30 (shown in phantom in FIG. 4C) located adjacent the LNA circuit 26. In operation, circular polarization is built into the antenna 14*a* as a result of the combination of the slot 28 and microstrip line 30, which excites electromagnetic waves received by the top metallization 20. In an alternative embodiment, the circular polarization may be achieved by providing a cross-aperture in the metal layer 24 in place of the substantially rectangular slot 28. In yet another alternative embodiment, circular polarization may be built into the top metallization 20 by moving the slot 28 and microstrip line 30 into the top metallization 20.

Figure 6A:
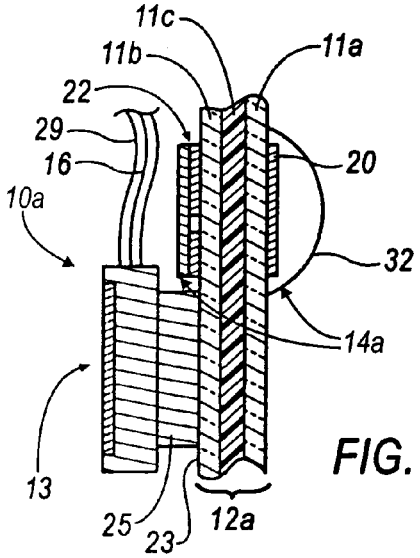
FIG. 6A illustrates a cross-sectional view of a rear-view mirror assembly and the front windshield glass mount antenna according to one embodiment of the invention.

Referring to FIG. 6A, a first implementation of the aperture-coupled slot-wave antenna 14*a* on the front windshield glass 12*a* is shown according to one embodiment of the invention. The aperture-coupled slot-wave antenna 14*a* is shown in a generally similar configuration as that in FIG. 4A expect that a radome 32 is located over the top metallization 20 so as to protect the top metallization 20 from the elements. The radome 32 is a thin, plastic element that has a low dielectric constant, which, as a result, appears transparent to electromagnetic waves received by the top metallization 20. To reduce the appearance of the aperture-coupled slot-wave antenna 14*a*, the bottom portion 22 of the slotted patch antenna array 14*a* is located on the passenger-compartment interior surface 23 of the glass layer 11*b* near an adjustment arm 25 of the rear-view mirror assembly 13. The bottom portion 22 may be affixed to the inner glass layer 11*b* by an adhesive and covered by a plastic closeout (not shown). As a result, the bottom portion 22 may be hidden by positioning the rear-view mirror assembly 13 proximate the bottom portion 22.

Figure 6B:
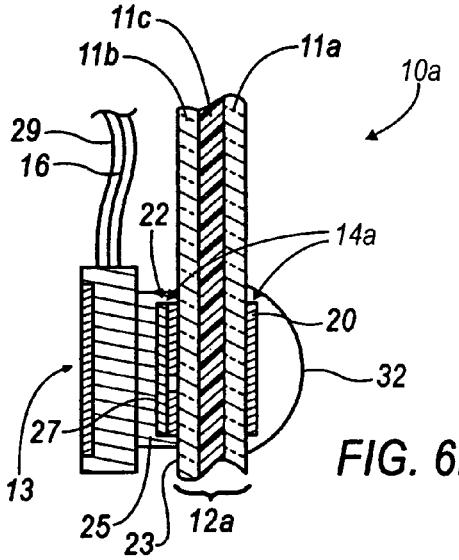
FIG. 6B illustrates a cross-sectional view of a rear-view mirror assembly and the front windshield glass mount antenna according to another embodiment of the invention.

In an alternative embodiment, as seen in FIG. 6B, the rear-view mirror assembly 13 may include a bezeled portion 27 located about the adjustment arm 25 that provides an adequate volume for housing the bottom portion 22. In this embodiment, the radome 32 covers the top metallization 20. In this implementation, the bezel 27 performs the dual function of completely hiding the bottom portion 22, but may also provide a routing of wires 16 from the bottom portion 22 with other wires 16 associated with and extending from the rear-view mirror assembly in a tube 29 to the headliner.

Figure 7A:
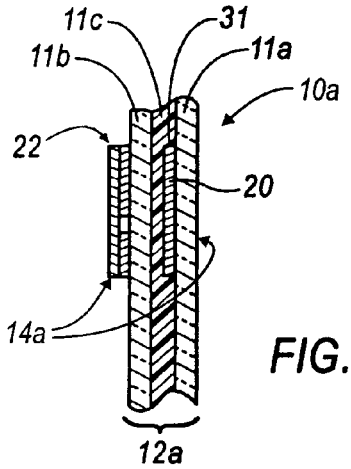
FIG. 7A illustrates a cross-sectional view of the front windshield glass mount antenna according to another embodiment of the invention.
Figure 7B:
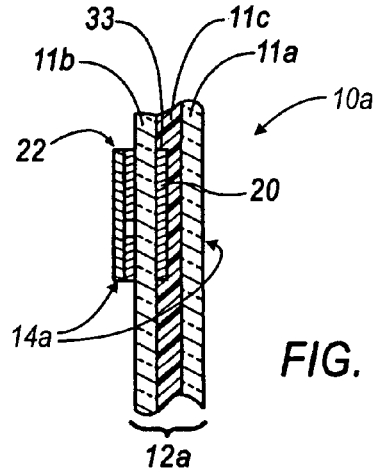
FIG. 7B illustrates a cross-sectional view of the front windshield glass mount antenna according to another embodiment of the invention.
Figure 8A:
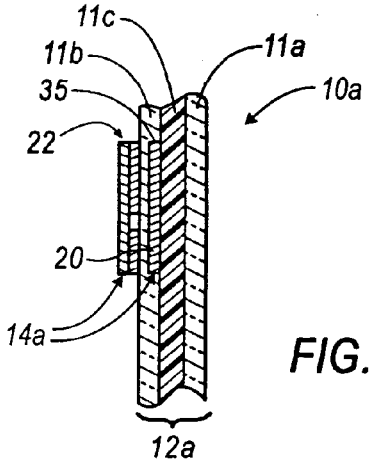
FIG. 8A illustrates a cross-sectional view of the front windshield glass mount antenna according to another embodiment of the invention.
Figure 8B:
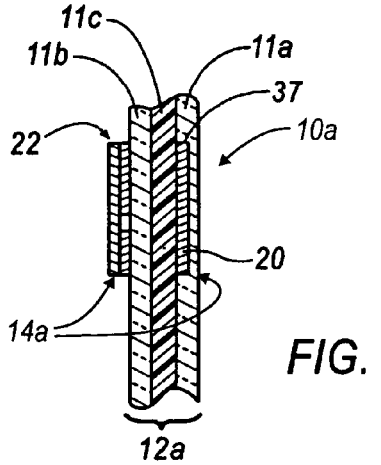
FIG. 8B illustrates a cross-sectional view of the front windshield glass mount antenna according to another embodiment of the invention.

As seen in FIGS. 7A and 7B, another embodiment of the antenna system 10*a* includes bezeled portions, illustrated generally at 31 and 33, in the intermediate plastic film layer 11*c*. As seen in FIG. 7A, the bezeled portion 31 is located adjacent to the outer glass layer 11*a*, and conversely as shown in FIG. 7B, the bezeled portion 33 is located adjacent the inner glass layer 11*b*. In yet another alternative embodiment, the glass layers 11*a*, 11*b* may each include bezeled portion, which are illustrated generally at 35 and 37 in FIGS. 8A and 8B, respectively. As seen in FIG. 8A, the bezeled portion 35 is located in the inner glass layer 11*b* adjacent the intermediate plastic film layer 11*c*, and conversely, as shown in FIG. 8B, the bezeled portion 37 is located in the outer glass layer 11*a* adjacent the intermediate plastic film layer 11*c*.

The alternative embodiments illustrated in FIGS. 7A–8B function in eliminating the radome 32 because the top metallization 20 is protected from the elements by integrating the top metallization 20 within any one of the layers 11*a*–11*c* of the front windshield glass 12*a*. Additionally, the alternate embodiments illustrated in FIGS. 7A–8B locates the top metallization 20 closer to the bottom portion 22 to reduce the distance that the received signal has to travel via the electromagnetic coupling between the front windshield glass 12*a*. As a result, electromagnetic coupling through the intermediate plastic film layer 11*c* may be passed completely when the bezeled portion is located as illustrated in FIGS. 7B and 8A when the inner glass layer 11*b* or plastic layer 11*c* is bezeled out at 33 and 35 such that the top metallization 20 is positioned directly adjacent the inner glass layer 11*b*. Although bezeled portions 31, 33, 35, 37 are illustrated in FIGS. 7A–8B, the top metallization 20 may include a reduced thickness such that the top metallization 20 is sandwiched between any one of the layers 11*a*–11*c* without including a bezeled portion 31, 33, 35, 37. However, if the top metallization 20 is sandwiched between the layers 11*a*–11*c* without the bezeled portion 31, 33, 35, 37, the material comprising top metallization 20 and/or the layers 11*a*–11*c* may have to be altered so as to compensate for material expansion considerations. Additionally, although the alternate embodiments illustrated in FIGS. 7A–8B do not show the combination of a bezel 31, 33, 35, 37 used in conjunction with the mounting of the bottom portion 22 within the adjustment arm 25 of the rear-view mirror assembly 13, any one of the illustrated bezels 31, 33, 35, 37 may be used in combination with the location of the bottom portion 22 within the adjustment arm 25 as shown in FIG. 6B.

Figure 5B:
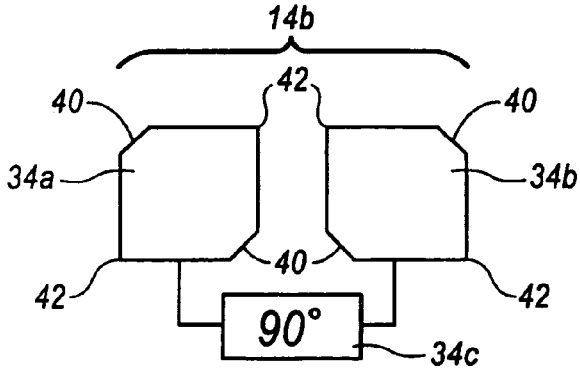
FIG. 5B illustrates a schematic top view of the rear windshield glass mount antenna according to FIG. 5A.

Referring now to FIGS. 5A and 5B, the antenna unit 14*b*, which is hereinafter referred to as an antenna array 14*b*, illustrates another embodiment of a vehicular glass mount patch antenna. The antenna array 14*b* includes a 90-degree phase shift circuit 34*c* intermediately disposed between the two patch elements 34*a*, 34*b* adjacent the interior surface 39 of the rear windshield glass 12*b*. As illustrated, a dielectric layer 38 and a bottom metal layer 36 are disposed below the patch antenna elements 34*a*, 34*b* and phase shift circuit 34*c*.

Referring to FIG. 5B, the antenna array 14*b* is essentially a high-gain dual element antenna such that the dual elements are spatially orientated by 90-degrees with respect to each other so as to provide better axial ratio and more radiation to compensate the inherent losses due to the dielectric constant of the rear windshield glass 12*b*. As illustrated, the antenna elements 34*a*, 34*b* include symmetrically cut corners 40 to create left-hand circular polarization for the antenna array 14*b*. Alternatively, if the opposing corners 42 were to be cut, the antenna array 14*b* would be a right-hand circular polarized antenna.

Figure 9A:
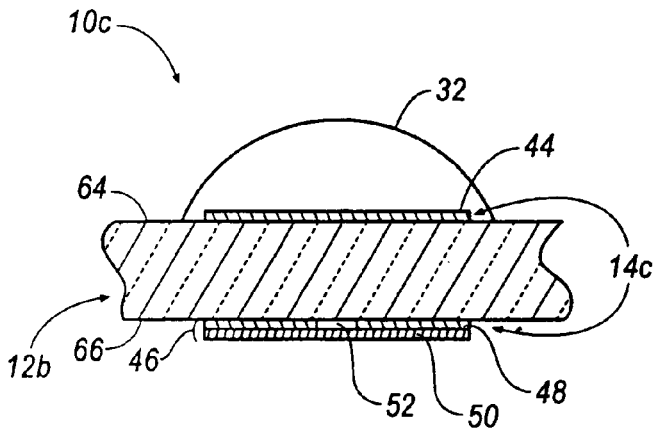
FIG. 9A illustrates a cross-sectional view of a rear backglass glass mount GPS antenna according to one embodiment of the invention.
Figure 9B:
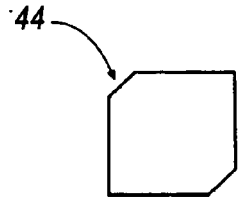
FIG. 9B illustrates a top view of a first element of the rear backglass glass mount GPS antenna according to FIG. 9A.
Figure 9C:
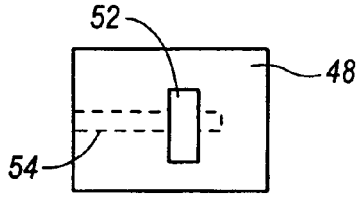
FIG. 9C illustrates a top view of a second element of the rear backglass glass mount GPS antenna according to FIG. 9A.

As seen in FIGS. 9A–9C, an antenna system 10*c* includes an aperture coupled, slot-wave GPS antenna unit 14*c*, provides a vehicular glass mount patch antenna while also improving electromagnetic coupling performance over conventional rear windshield-mount GPS antennas. The aperture coupled, slot-wave antenna 14*c* is essentially a two-element antenna system such that the radiation element is electromagnetically coupled through the rear windshield glass 12*b* to an excitation part located on the interior surface of the rear windshield glass 12*a*.

As illustrated, the first element of the aperture coupled, slot-wave antenna 14*c* includes a right-hand circularly polarized top metallization 44 (i.e. the radiation element). Because the top metallization 44 is right-hand circularly polarized, the top metallization receives GPS signals and may include any desirable conducting material, such as, for example, a silver conducting film. In an alternative embodiment, the top metallization 44 may include an optically transparent conducting film comprising, for example, indium peroxide, to reduce the appearance of the aperture-couple slot-wave antenna 14*c* located about the rear windshield glass 12*c*. The second element of the aperture coupled, slot-wave antenna 14*c* includes a bottom portion 46 (i.e. the excitation element) that is electromagnetically coupled through the rear windshield glass 12*b*. The bottom portion 46 includes a substantially rectangular metal layer 48 and low noise amplifier (LNA) circuit 50. As similarly described with respect to the bottom portion 22 in FIG. 4C, the metal layer 48 is further defined to include an absence of material in the form of a substantially off-centered rectangular slot 52. Additionally, the metal layer 48 is excited by a microstrip line 54 (shown in phantom in FIG. 9C) located adjacent the LNA circuit 50. In operation, the combination of the slot 52 and microstrip line 54 excites electromagnetic waves received by the top metallization 44.

Figure 10A:
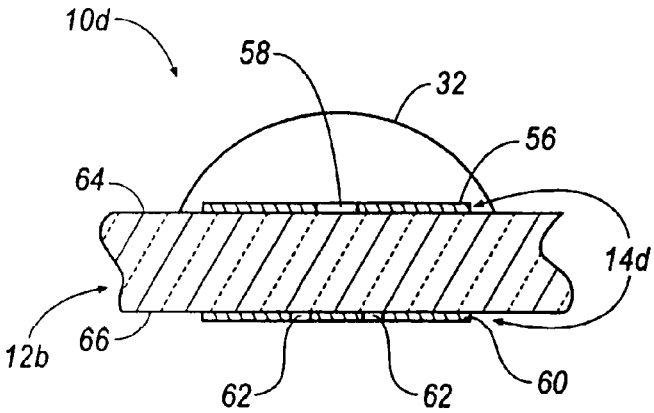
FIG. 10A illustrates a cross-sectional view of a rear windshield glass mount GPS antenna according to one embodiment of the invention.
Figure 10B:
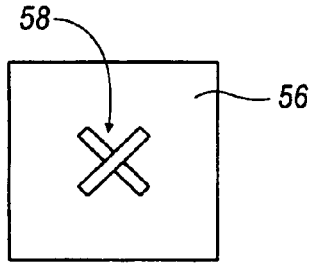
FIG. 10B illustrates a top view of a first element of the rear windshield glass mount GPS antenna according to FIG. 10A.
Figure 10C:
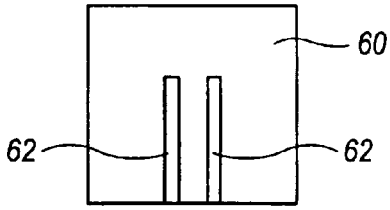
FIG. 10C illustrates a top view of a second element of the rear windshield glass mount GPS antenna according to FIG. 10A.

Referring to FIGS. 10A–10C, another embodiment of the invention includes an antenna system 10*d* includes a GPS antenna unit 14*d* defined by a co-planar-type feed comprising a top metallization 56 including a cross-aperture-shaped slot 58 and a bottom metallization 60 including a pair of parallel slots 62.

Both embodiments of the invention described in FIGS. 9A and 10A include the top metallization 44, 56, which is covered by a radome 32 and located on the exterior surface 64 of the glass 12*b*. The bottom portion 46 is located on the interior surface 66 of the glass 12*b* and may be protected by a plastic cover (not shown), or, alternatively, the bottom portion may be housed within the rear-brake-light housing bezel (not shown). According to another embodiment of the invention as shown in FIGS. 11A–11E, antenna systems 10*c*–10*i* may include any desirable location of the top metallization 44, 56 and bottom portion 46 about the rear windshield glass 12*b*. Although the antenna unit 14*c* (refer FIG. 9A) is shown located within the glass 12*b* in FIGS. 11A–11E, the antenna unit 14*d* (refer FIG. 10A) or any other desirable antenna unit may be located within the rear windshield glass 12*b* as shown.

Figure 11A:
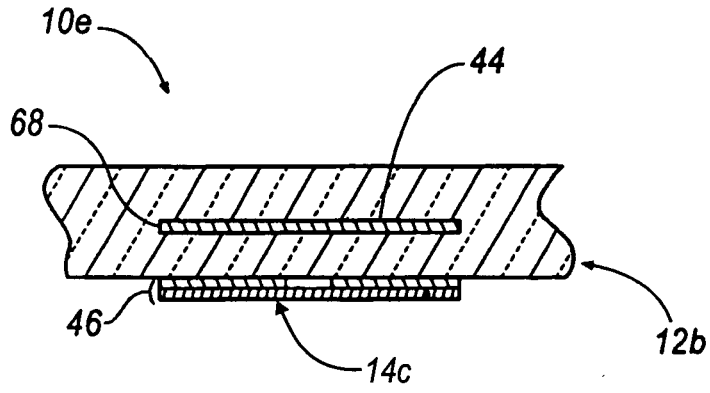
FIGS. 11A–11E illustrate cross-sectional views of rear windshield glass mount GPS antenna assemblies according to multiple embodiments of the invention that may include the antenna elements of FIGS. 9B, 9C or 10B, 10C.
Figure 11B:
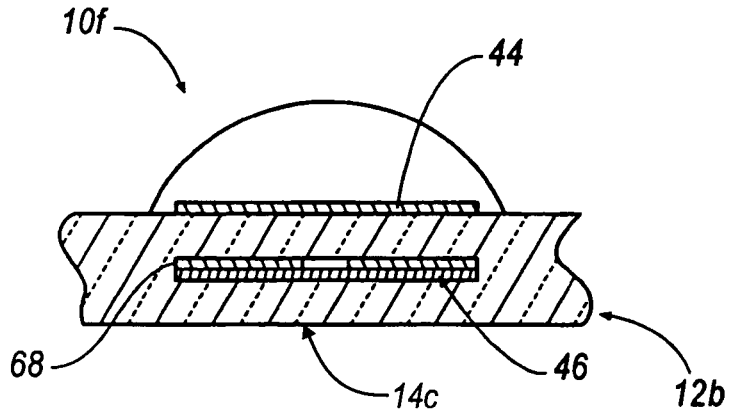
Figure 11C:
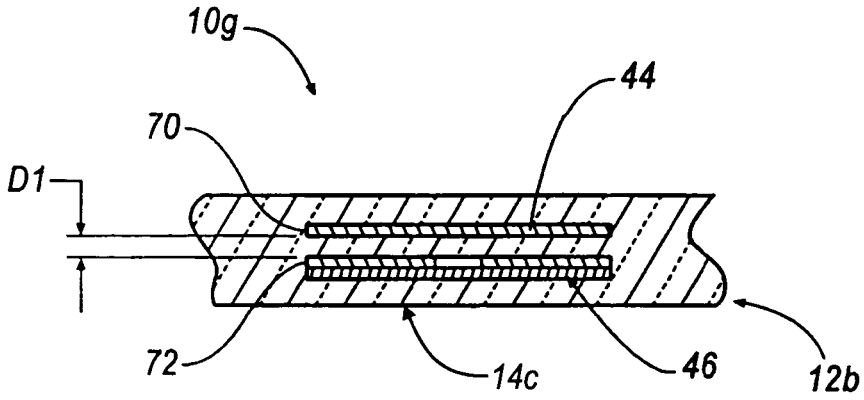
Figure 11D:
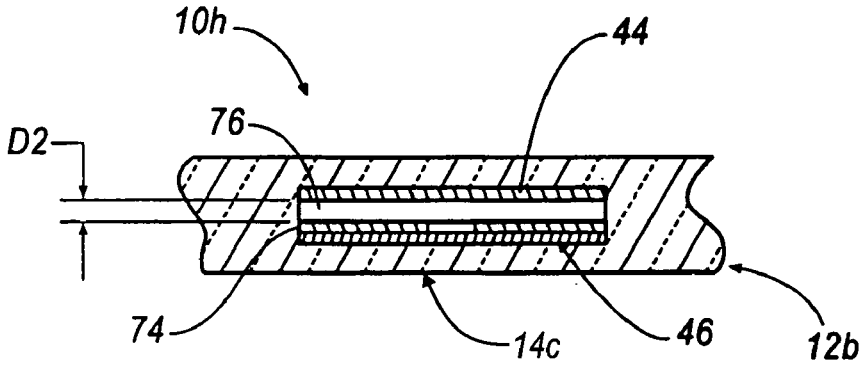
Figure 11E:
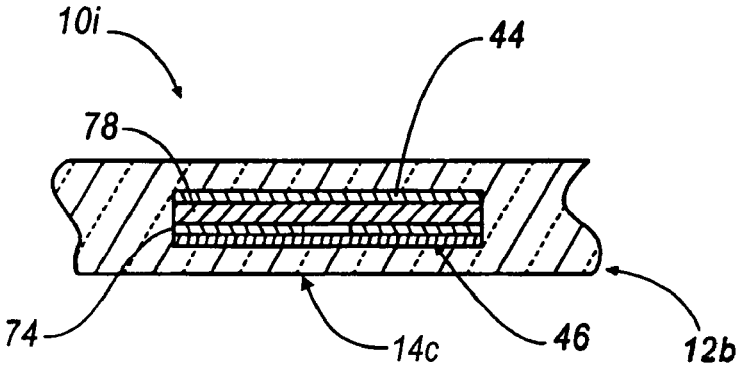

As seen in FIG. 11A, the top metallization may be located within a pocket 68 formed in the glass 12*b*. Alternatively, as seen in FIG. 11B, the bottom portion 46 may be located within the pocket 68. According to yet another embodiment of the invention as shown in FIG. 11C, a pair of pockets 70, 72 formed in the glass 12*b* may maintain the top metallization 44, 56 and bottom portion 46 in an opposing relationship and spaced at a distance, D1, within the glass 12*b*. According to yet another embodiment of the invention as shown in FIG. 11D, a single pocket 74 is formed in the glass 12*b* to maintain the top metallization 44, 56 and bottom portion 46 in an opposing relationship with an intermediate air gap 76 defined by a separation distance, D2. Alternatively, as seen in FIG. 11E, rather than including an air gap 76 within the single pocket 74, a dielectric material 78 may be intermediately located between the top metallization 44, 56 and bottom portion 46. If desired, any embodiment of the invention described above may be incorporated into a diversity antenna configuration if a diversity GPS receiver (not shown) is incorporated into the vehicle.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An antenna system, comprising:

a vehicle including a rear windshield glass; and a global positioning system antenna unit including a radiating element electromagnetically coupled to an excitation element about the rear windshield glass, wherein the radiating element is positioned within a pocket formed in the rear windshield glass, and the excitation element is positioned on a passenger compartment interior surface of the rear windshield glass.

2. An antenna system, comprising:

a vehicle including a rear windshield glass; and a global positioning system antenna unit including a radiating element electromagnetically coupled to an excitation element about the rear windshield glass, wherein the radiating element is positioned on an exterior surface of the rear windshield glass, and the excitation element is positioned within a pocket formed in the rear windshield glass.

3. An antenna system, comprising:

a vehicle including a rear windshield glass; and a global positioning system antenna unit including a radiating element electromagnetically coupled to an excitation element about the rear windshield glass, wherein the radiating element is positioned within a first pocket formed in the rear windshield glass, and the excitation element is positioned within a second pocket formed in the rear windshield glass in an opposing relationship with respect to the radiating element.

4. An antenna system, comprising:

a vehicle including a rear windshield glass; and a global positioning system antenna unit including a radiating element electromagnetically coupled to an excitation element about the rear windshield glass, wherein the radiating element and excitation element are positioned within a pocket formed in the rear windshield glass in an opposing relationship and are spaced by an intermediate air gap.

5. An antenna system, comprising:

a vehicle including a rear windshield glass; and a global positioning system antenna unit including a radiating element electromagnetically coupled to an excitation element about the rear windshield glass, wherein the radiating element and excitation element are positioned within a pocket formed in the rear windshield glass in an opposing relationship and are spaced by an intermediate dielectric material.

* * * * *